US006027229A

United States Patent [19]

Wang

[11] Patent Number: 6,027,229

[45] Date of Patent: Feb. 22, 2000

[54] COMBINED TABLE LAMP AND CLOCK ASSEMBLY

[76] Inventor: I-Hwa Wang, No. 16, Kuo-Tai Lane, Sec. 2, Chang-Ping Rd., Pei-Tun Dist., Taichung City, Taiwan

[21] Appl. No.: 09/218,714

[22] Filed: Dec. 22, 1998

[51] Int. Cl.[7] ..... F21V 33/00

[52] U.S. Cl. ..... 362/253; 362/410; 362/414; 362/806

[58] Field of Search ..... 362/253, 410, 362/414, 806; D10/5, 6; D26/54

[56] References Cited

U.S. PATENT DOCUMENTS

| | | | |
|---|---|---|---|
| D. 329,711 | 9/1992 | Adams et al. | D26/54 |
| D. 345,922 | 4/1994 | Clincy | D10/5 |
| D. 345,924 | 4/1994 | Clincy | D10/5 |
| 3,368,067 | 2/1968 | Paxinos | 362/253 |

*Primary Examiner*—Thomas M. Sember
*Attorney, Agent, or Firm*—Ladas & Parry

[57] ABSTRACT

A combined table lamp and clock assembly includes a base adapted to be placed on a table top, a lamp device, a stand, and a clock unit. The lamp base includes a lamp base, a lamp bulb mounted on the lamp base, an electrical plug, and an electrical wire interconnecting the lamp base and the electrical plug. The stand has an upper end portion, a lower end portion and an intermediate portion between the upper and lower end portions. The lower end portion is mounted on the base. The stand further has a back side provided with a resilient lamp base retainer that extends rearwardly from the upper end portion of the stand and that engages fittingly the lamp base of the lamp device. The back side of the stand is further provided with a wire positioning member at the intermediate portion of the stand to secure a section of the electrical wire of the lamp device on the stand. The clock unit is mounted on the intermediate portion of the stand.

13 Claims, 5 Drawing Sheets

COMBINED TABLE LAMP AND CLOCK ASSEMBLY

BACKGROUND OF THE INVENTION

1. Field of the Invention

The invention relates to a combined table lamp and clock assembly which has a changeable appearance and which is easy to manufacture and assemble.

2. Description of the Related Art

Conventional table lamps are generally formed from rigid plastic or metal materials. There are various types of table lamps, and some have a colorful appearance or a cute design that particularly appeal to children. However, although there are different types of table lamps, their appearance is often fixed and unchangeable and fails to meet consumers' demand for variety. Furthermore, most types of table lamps are not provided with a clock or timepiece. Although there has been developed a kind of table lamp with a digital clock, it is not recommended for children as they need to be trained to be able to tell time by looking at the hands of a clock.

SUMMARY OF THE INVENTION

Therefore, the main object of the present invention is to provide a combined table lamp and clock assembly which has an appealing appearance and which can encourage children to learn to tell time by looking at the hands of the clock assembly.

Accordingly, the combined table lamp and clock assembly of the present invention includes a lamp device, a base, a stand, and a clock unit. The lamp device includes a lamp base, a lamp bulb mounted on the lamp base, an electrical plug adapted for electrical connection with an electrical outlet, and an electrical wire having a first end connected electrically to the lamp base and an opposite second end connected electrically to the electrical plug. The base has a top side and a bottom side which is adapted to be placed on a table top. The stand has an upper end portion, a lower end portion and an intermediate portion between the upper and lower end portions. The lower end portion is mounted on the top side of the base. The stand further has a back side provided with a resilient lamp base retainer that extends rearwardly from the upper end portion of the stand and that engages fittingly the lamp base of the lamp device. The back side of the stand is further provided with at least one wire positioning member at the intermediate portion of the stand to secure at least one section of the electrical wire of the lamp device on the stand. The clock unit is mounted on the intermediate portion of the stand.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
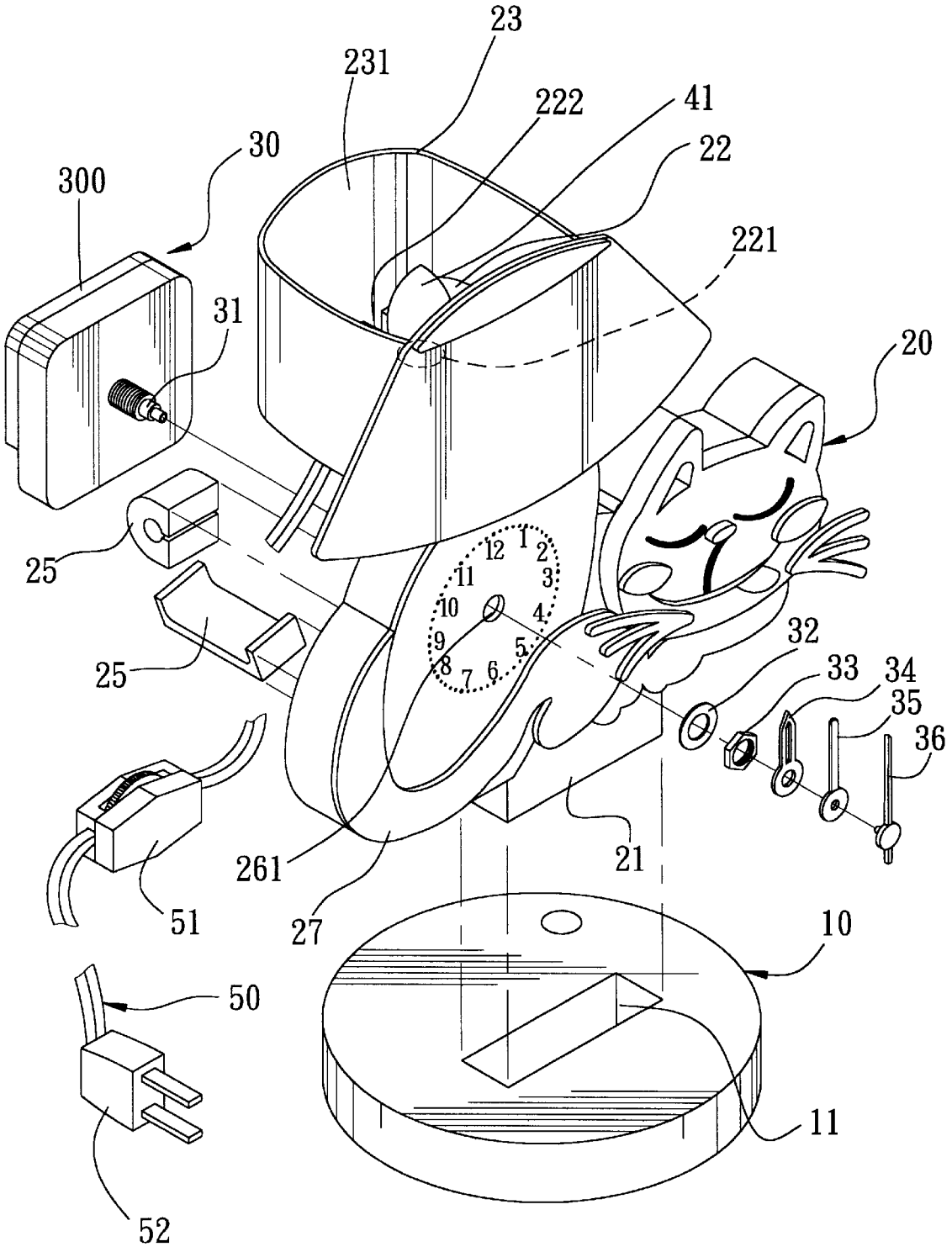
FIG. 1 is a perspective exploded view of a preferred embodiment of a combined table lamp and clock assembly according to the invention.
Figure 2:
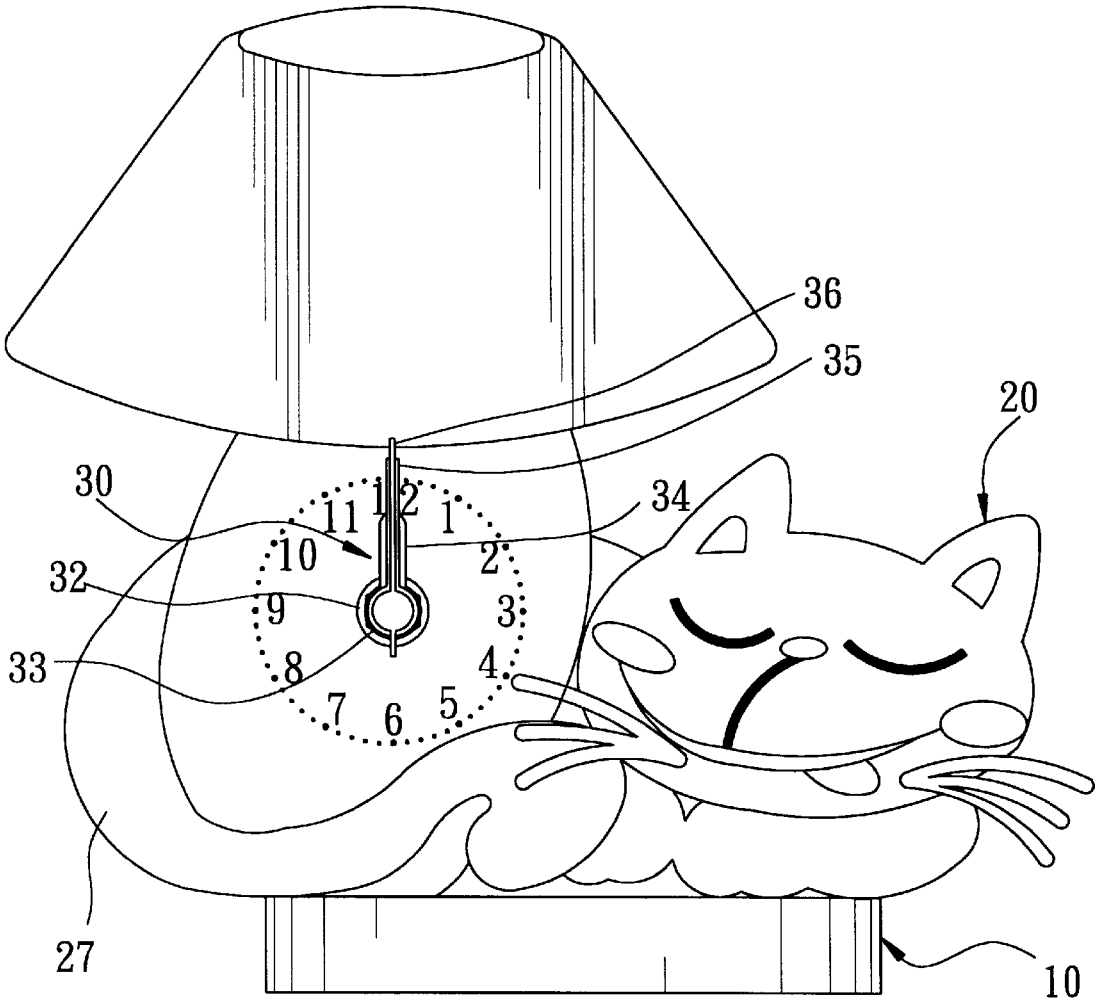
FIG. 2 is an elevation view of the preferred embodiment, viewed from a front side thereof.
Figure 3:
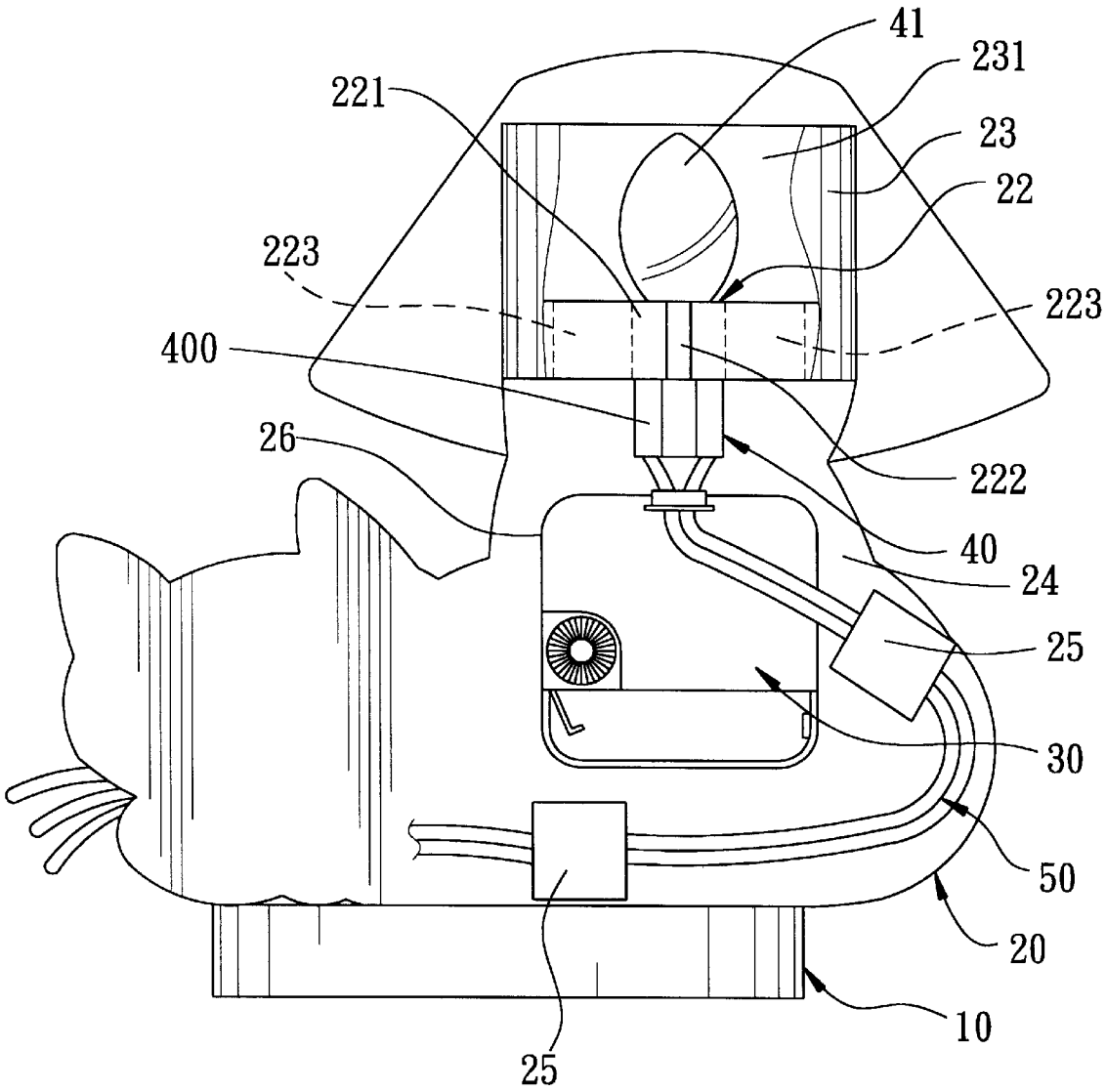
FIG. 3 is an elevation view of the preferred embodiment, viewed from a rear side thereof.

Referring to FIGS. 1 to 3, the preferred embodiment of the combined table lamp and clock assembly of the present invention is shown to include a base 10, a stand 20, a clock unit 30, and a lamp device 40.

The base 10 is formed from a resilient foam material, preferably a flame retardant foam material, such as ethyl vinyl acetate (EVA) . The base 10 has a top side formed with a stand engaging groove 11, and a bottom side adapted to be placed on a table top.

The stand 20 is also formed from a foam material, preferably a flame retardant foam material, such as EVA. The stand 20 includes an upper end portion, a lower end portion 21, and an intermediate portion between the upper and lower end portions. The lower end portion 21 is insertable into the stand engaging groove 11 of the base 10 to engage removably the latter. The stand 20 further has a back side 24 provided with a resilient lamp base retainer that extends rearwardly from the upper end portion of the stand 20, and two wire positioning members 25 at the intermediate portion of the stand 20. The lamp base retainer includes a horizontally extending plate 22 made of a foam material and formed with a lamp base retaining hole 221. The horizontally extending plate 22 is formed with an upright slit 222 that is communicated with the lamp base retaining hole 221, and a plurality of heat dissipating holes 223 adjacent to the lamp base retaining hole 221. The back side 24 of the stand 20 is further provided with an upright enclosing wall 23 that surrounds the horizontally extending plate 22 and that has opposite upright ends mounted on the upper end portion of the stand 20. The enclosing wall 23, which is preferably made of a foam material, cooperates with the upper end portion of the stand 20 to form a shade that confines a space 231. The back side 24 of the stand 20 is further provided with a cavity 26 in the intermediate portion of the stand 20 for receiving the clock unit 30. The stand 20 further has a front side 27 provided with a clock face at the intermediate portion of the stand 20. The cavity 26 has a central through hole 261 extending from the back side 24 to the front side 27 of the stand 20.

The lamp device 40 includes a lamp base 400, a lamp bulb 41 mounted on the lamp base 400 and received in the space 231 confined by the upright enclosing wall 23 of the stand 20, an electrical plug 52 adapted for electrical connection with an electrical outlet (not shown), and an electrical wire 50 having a first end connected electrically to the lamp base 400 and an opposite second end connected electrically to the electrical plug 52. The electrical wire 50 passes through the wire positioning members 25 on the back side 24 of the stand 20. Each of the wire positioning members 25 is formed as a flexible strip that is folded to confine a through hole for extension of the electrical wire 50 therethrough and that has opposite ends mounted on the back side 24 of the stand 20 to secure the electrical wire 50 on the stand 20.

The clock unit 30 is mounted on the intermediate portion of the stand 20, and includes a hand driving mechanism and a clock hand set. The hand driving mechanism has a housing 300 mounted on the back side 24 of the stand 20 in the cavity 26, and a clock hand driver 31 that extends from the housing 300 and that extends from the back side 24 through the front side 27 of the stand 20 via the through hole 261. The clock hand set is mounted on the clock hand driver 31 and is disposed adjacent to the front side 27 of the stand 20. The clock hand set is driven by the clock hand driver 31 so as to cooperate with the clock face to indicate time. The clock hand set includes an hour hand 34, a minute hand 35, and a second hand 36.

Figure 5:
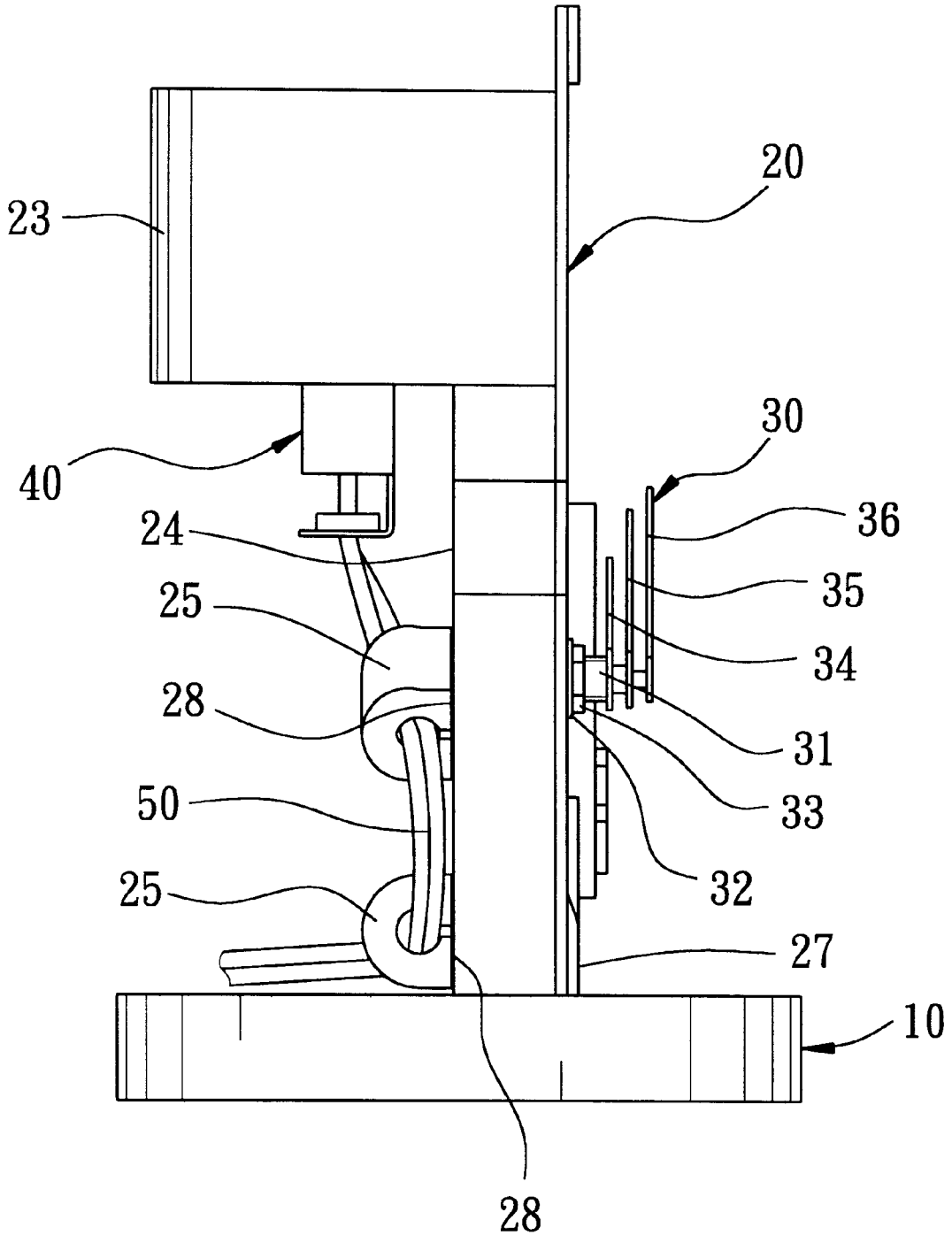
FIG. 5 is an elevation view of the preferred embodiment, viewed from one side thereof.

In assembly, referring to FIGS. 1 and 3, the clock unit 30 is fitted into the cavity 26 on the back side 24 of the stand 20, with the clock hand driver 31 extending through the central through hole 261 to project from the front side 27 of the stand 20. The clock unit 30 is then locked in position by means of a packing ring 32 and a nut 32. Then, the hour hand 34, the minute hand 35, and the second hand 36 are mounted onto the clock hand driver 31 in sequence. Referring to FIG. 5, the wire positioning members 25 are made of a foam material and are in the form of flexible strips before being attached to the back side 24 of the stand 20. In assembly, the wire positioning members 25 are folded into a substantially C-shape to envelop portions of the electrical wire 50, and an appropriate amount of glue or adhesive 28 is applied to adhere the wire positioning members 25 to the back side 24 of the stand. Hence, the electrical wire 50 can be positioned stably on the back side 24 of the stand 20 in an orderly manner. Subsequently, the lamp device 40 is inserted into the lamp base retaining hole 221 of the horizontally extending plate 22 from below, and the lamp bulb 41 is mounted on the lamp base 400, thus accomplishing assembly of the combined table lamp and clock assembly of the present invention.

Figure 4:
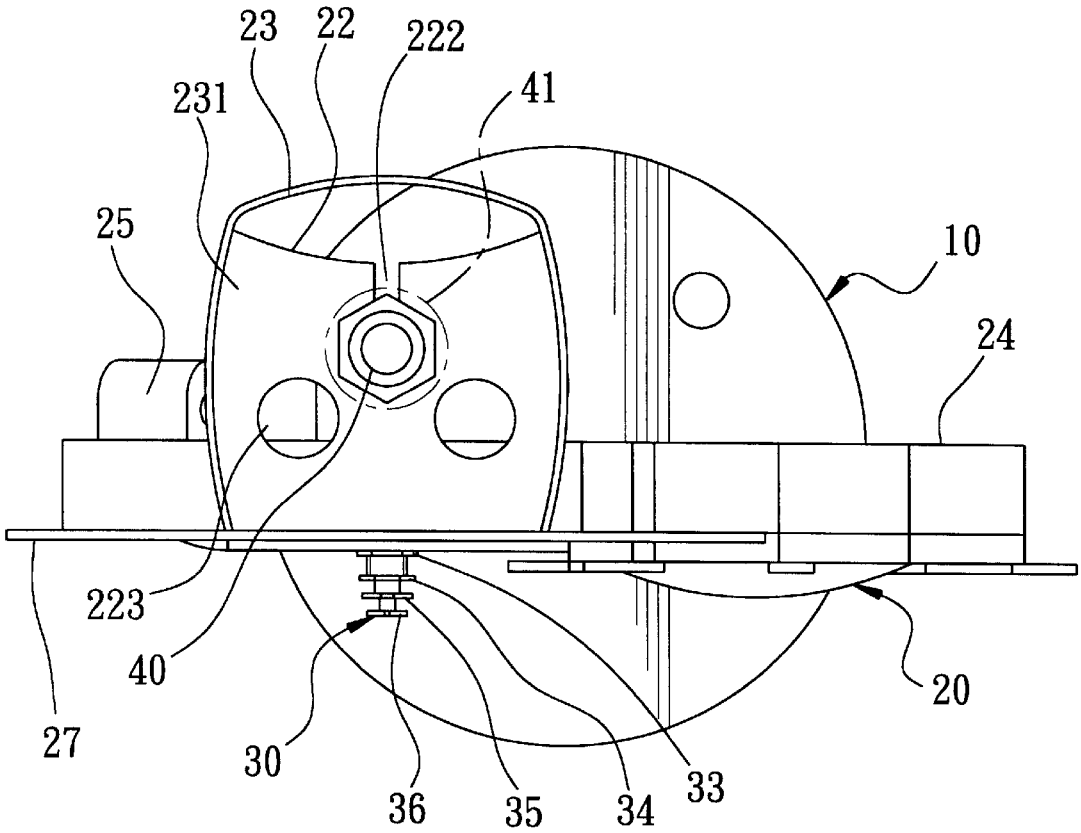
FIG. 4 is an elevation view of the preferred embodiment, viewed from a top side thereof.

With reference to FIGS. 3 and 4, after the lamp device 40 has been secured in the lamp base retaining hole 221 of the horizontally extending plate 22, the lamp bulb 41 is located in the space 231 confined by the upright enclosing wall 23. The heat dissipating holes 223 adjacent to the lamp base retaining hole 221 help dissipate the heat generated by the lamp bulb 41 when the lamp device 40 operates to prevent overheating.

Preferably, the electrical wire 50 has an intermediate section connected to an electrical on/off switch 51 adapted to control on and off operation of the lamp bulb 41 of the lamp device 40.

In the present embodiment, the stand 20 has an appearance in the form of a cat. Certainly, it may have an appearance other than the form of a cat.

In the present invention, since the base 10, the stand 20, and the clock unit 30 are mounted releasably to one another, assembly thereof is easy and quick. Besides, as the electrical wire 50 can be secured stably by the wire positioning members 25 without having to go around the base 10, the base 10 can stand more stably on the table top, and the electrical wire 50 can have a neat appearance on the stand 20. In addition, the provision of the slit 222 enables the lamp base 400 to be held tightly therein without slippage. More importantly, it is only necessary to pull the lamp bulb 41 out of the slit 222 to replace it with a new one, which is very convenient.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A combined table lamp and clock assembly, comprising:

a lamp device including a lamp base, a lamp bulb mounted on said lamp base, an electrical plug adapted for electrical connection with an electrical outlet, and an electrical wire having a first end connected electrically to said lamp base and an opposite second end connected electrically to said electrical plug;

a base having a top side and a bottom side which is adapted to be placed on a table top;

a stand having an upper end portion, a lower end portion and an intermediate portion between said upper and lower end portions, said lower end portion being mounted on said top side of said base, said stand further having a back side provided with a resilient lamp base retainer that extends rearwardly from said upper end portion of said stand and that engages fittingly said lamp base of said lamp device, said back side of said stand being further provided with at least one wire positioning member at said intermediate portion of said stand to secure at least one section of said electrical wire of said lamp device on said stand; and a clock unit mounted on said intermediate portion of said stand.

2. The combined table lamp and clock assembly as claimed in claim 1, wherein said top side of said base is formed with a stand engaging groove for engaging said lower end portion of said stand.

3. The combined table lamp and clock assembly as claimed in claim 1, wherein said lamp base retainer includes a horizontally extending plate made of a foam material and formed with a lamp base retaining hole for engaging fittingly said lamp base of said lamp device.

4. The combined table lamp and clock assembly as claimed in claim 3, wherein said horizontally extending plate is formed with an upright slit that is communicated with said lamp base retaining hole for enhanced engagement between said lamp base retainer and said lamp base.

5. The combined table lamp and clock assembly as claimed in claim 3, wherein said back side of said stand is further provided with an upright enclosing wall that surrounds said horizontally extending plate and that has opposite upright ends mounted on said upper end portion of said stand, said enclosing wall cooperating with said upper end portion of said stand to form a shade for said lamp bulb of said lamp device.

6. The combined table lamp and clock assembly as claimed in claim 5, wherein at least one of said base, said stand and said enclosing wall is made of a foam material.

7. The combined table lamp and clock assembly as claimed in claim 3, wherein said horizontally extending plate is further formed with at least one heat dissipating hole adjacent to said lamp base retaining hole.

8. The combined table lamp and clock assembly as claimed in claim 1, wherein said wire positioning member is formed as a flexible strip that is folded to confine a through hole for extension of said electrical wire therethrough and that has opposite ends mounted on said back side of said stand to secure said electrical wire on said stand.

9. The combined table lamp and clock assembly as claimed in claim 8, wherein said flexible strip is made of a foam material.

10. The combined table lamp and clock assembly as claimed in claim 1, wherein said stand further has a front side provided with a clock face at said intermediate portion of said stand, said clock unit including a hand driving mechanism having a housing mounted on said back side of said stand at said intermediate portion, and a clock hand driver that extends from said housing and that extends from said back side through said front side of said stand, and a clock hand set mounted on said clock hand driver and disposed adjacent to said front side of said stand, said clock hand set being driven by said clock hand driver so as to cooperate with said clock face to indicate time.

11. The combined table lamp and clock assembly as claimed in claim 10, wherein said back side of said stand is formed with a cavity in said intermediate portion of said stand for engaging fittingly said housing of said hand driving mechanism.

12. The combined table lamp and clock assembly as claimed in claim 11, wherein said stand is made of a foam material.

13. The combined table lamp and clock assembly as claimed in claim 1, wherein at least one of said base and said stand is made of a foam material.

* * * * *